US005379566A

United States Patent [19]

Schwörer

[11] Patent Number: 5,379,566

[45] Date of Patent: Jan. 10, 1995

[54] ADJUSTABLE-HEIGHT POST

[75] Inventor: Artur Schwörer, Baden-Württemberg, Germany

[73] Assignee: Peri GmbH, Weissenhorn, Germany

[21] Appl. No.: 2,799

[22] Filed: Jan. 11, 1993

[30] Foreign Application Priority Data

Jan. 25, 1992 [DE] Germany ..... 4206573

[51] Int. Cl.[6] ..... E04G 25/08; E04H 12/18

[52] U.S. Cl. ..... 52/632; 52/105; 411/553; 411/418; 411/437; 248/354.3

[58] Field of Search ..... 411/553, 551, 540, 418, 411/437; 52/105, 632, 710, 243.1, 118; 403/109, 377; 182/178, 179; 248/354.3, 354.6, 405; 254/98

[56] References Cited

U.S. PATENT DOCUMENTS 2,745,622 5/1956 Zindel ..... 52/632
2,828,662 4/1958 Antal ..... 411/437
4,026,076 5/1977 Morris ..... 403/109
4,472,883 9/1984 Ortega ..... 52/105
4,561,798 12/1985 Elerin et al. ..... 403/109
4,770,560 9/1988 Ott ..... 411/418

FOREIGN PATENT DOCUMENTS 1915287 3/1969 Germany .
1047244 11/1966 United Kingdom ..... 411/437

*Primary Examiner*—Peter M. Cuomo
*Assistant Examiner*—Darnell M. Boucher
*Attorney, Agent, or Firm*—Fields, Lewis, Pittenger & Rost

[57] ABSTRACT

An adjustable-height post (10) for construction formwork, which is preferably made of aluminum, consists of an outer tube (12) to which a threaded nut is fastened in a lossproof manner, and an inner tube (11) that has thread segments (13, 14) on the outer surface. The segments (13, 13', 13'', 13''') project into recesses (19, 19', 19'', 19''') of the outer tube (12). This embodiment produces a robust post (10) whose inner tube (11) is nonrotatably supported and guided in the outer tube (12). The inner tube (11) can more easily be manufactured with the threads (14) according to the invention; at the same time, material can be saved in the manufacture of the post (10).

4 Claims, 1 Drawing Sheet

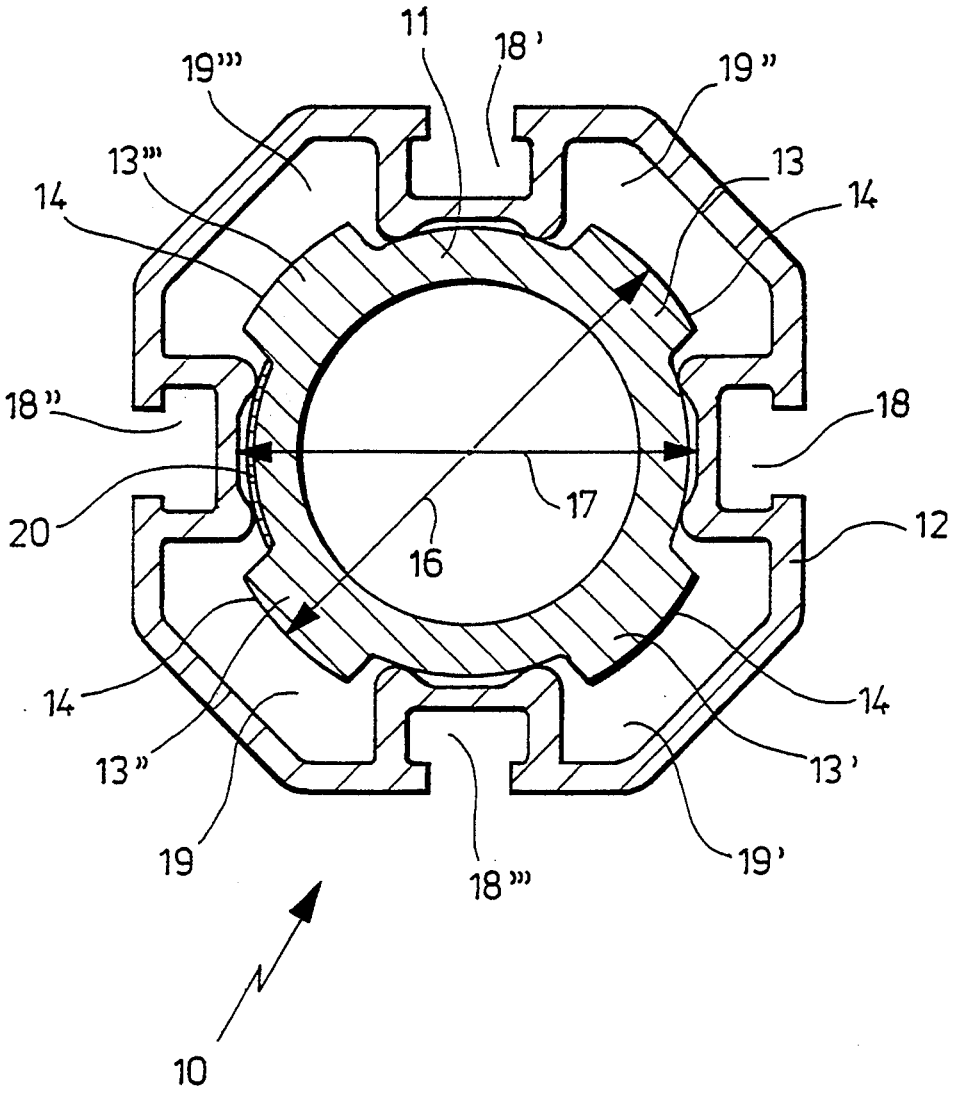
11
18'
19'''
19''
13'''
13
14
14
18''
18
20
17
12
16
14
14
13''
13'
19
19'
18'''
10

ADJUSTABLE-HEIGHT POST

The invention relates to an adjustable-height post for construction formwork, consisting of an outer tube with a threaded nut and an inner tube that has threads on the outer surface.

A post of this kind has been disclosed in the Ischebeck brochure W 54/0389/5 for aluminum formwork scaffolding.

In the known posts, the inner tube is implemented as a spindle that interacts with a threaded nut of the outer tube. Provided on the outer surface of the outer tube are protrusions into which stiffeners can be fastened by means of insertion screws.

The object of the invention is to develop the known posts so as to improve them in terms of handling, and so that they better meet requirements on the construction site.

According to the invention, this object is achieved by the fact that the threads are interrupted when viewed over the circumference of the inner tube.

The advantage of this is that the threads according to the invention are less sensitive to dirt. Mortar residues can more easily be knocked off because a larger space is present between the threaded portions. When dirt residues are knocked off, the threads themselves are also protected, since mechanical action, for example by means of a hammer, does not need to be applied directly onto the threaded segment of the inner tube.

Furthermore, production of the post according to the invention, i.e. formation of the threaded segments, is simpler and more cost-effective. The adjustable-height posts under discussion here are increasingly being made of aluminum. Aluminum is an expensive raw material, meaning that by a skillful arrangement of threaded segments, a considerable quantity of raw material can be saved without impairing the function of such a post. Segmented threads are easier to impress—i.e. to roll or cut—onto the outer surface of the inner tube. Dirt residues between the threaded segments can thus be more easily broken away, or will more easily fall away of themselves.

If the threaded segments engage in recesses of the outer tube, this is the simplest way of configuring the inner tube nonrotatably with respect to the outer tube. If the height of the post according to the invention needs to be adjusted, one need simply rotate the threaded nut fastened in a lossproof manner to the outer tube. Once the desired post height has been reached, the threaded connection between the inner tube and outer tube is tightened. The spindle itself does not need to be retained in this process, since these threaded segments lock into the recesses; the inner tube is nonrotatably guided in the outer tube. It is essential to the invention, in this connection, that a nonrotatable positive engagement results regardless of the cross-sectional shape of the inner and outer tubes. The advantages just mentioned can also be utilized if the post according to the invention is made not of aluminum but of steel or another material suitable therefor.

In a further embodiment of the invention, a scale is provided on the outer surface of the inner tube. This scale extends along the inner tube, so that the desired height of a post can very easily be adjusted and read off.

In addition, fastening devices, especially indentations, can be provided on the outer surface of the outer tube.

By means of these indentations, stiffeners can be fastened in a known manner with insertion screws.

Also part of the invention is a method for manufacturing the adjustable-height post according to the invention. The threaded segments can easily be stamped onto the outer surface of the inner tube using known devices.

Further advantages are evident from the description and the attached drawings. The features mentioned above and those referred to later can also, in accordance with the invention, each be used individually or in any combinations with one another. The embodiments mentioned are not to be understood as a definitive listing, but rather are exemplary in nature. The invention is depicted in the drawings, and will be explained with reference to a single exemplary embodiment.

The FIGURE of the drawings shows the subject of the invention in highly schematic fashion, and is not be understood as a scale drawing. The FIGURE shows a cross section through a post according to the invention, with the cross-sectional shapes of the outer tube and inner tube, in particular, understood to be exemplary.

The FIGURE shows a post 10 whose inner tube 11 and outer tube 12 are sectioned. Configured on the inner tube 11 are segments 13, 13', 13'', and 13∝'', each of which can represent a threaded portion, and threads 14 are provided on the outer surface of the segments 13, 13', 13'', 13'''.

The inner tube 11 has a diameter 16 that is greater than an inside diameter 17 which substantially defines the smallest opening width in the outer tube 12. Provided on the outer tube 12 are indentations 18, 18', 18'', and 18''' which, as shown in the FIGURE, are provided symmetrically on the outer tube 12. The indentations 18, 18', 18'', 18''' form recesses 19, 19', 19'', 19''' in the interior of the outer tube 12, into which recesses the segments 13, 13', 13'', 13''' of the inner tube 11 project. As the FIGURE clearly shows, the inner tube 11 is thereby nonrotatably guided and supported in the outer tube 12. The threads 14 on the inner tube 11 of the post 10 interact with a threaded nut (not shown in the FIGURE for the sake of clarity) of the outer tube 12. In a known manner, the height of the post 10 according to the invention can be continuously adjusted and firmly tightened without the application of counterforce.

Stiffeners can be fastened into the indentations 18, 18', 18'', and 18''' by means of insertion screws.

Furthermore, as shown in the FIGURE, there is arranged on the outer surface of the inner tube 11 a scale 20 that extends over the entire length of the inner tube 11. If the post 10 needs to be adjusted to a predefined length, the total length of the post can be read off from the scale 20.

An adjustable-height post 10 for construction formwork, which is preferably made from aluminum, consists of an outer tube 12 to which a threaded nut is fastened in a lossproof manner, and an inner tube 11 that has threaded segments 13, 14 on the outer surface. The segments 13, 13', 13'', and 13''' project into recesses 19, 19', 19'', 19''' of the outer tube 12. This configuration results in a robust post 10 whose inner tube 11 is nonrotatably supported and guided in the outer tube 12. With the threads 14 according to the invention, the inner tube 11 can be manufactured more easily, and at the same time material can be saved in the manufacture of the post 10.

We claim:

1. An adjustable-height post for construction formwork comprising: an essentially closed hollow outer tube having a plurality of recesses on an inner surface and an essentially closed hollow inner tube having threads on an inner tube outer surface, the threads having gaps spaced around the outer surface, and the threads fit non-rotatably into the recesses of the outer tube, whereby the inner tube is secured in the outer tube by a threaded nut.

2. Adjustable-height post according to claim 1, wherein a scale is provided on the outer surface of the inner tube.

3. Adjustable-height post according to claim 2, wherein fastening devices are provided on the outer surface of the outer tube.

4. Adjustable-height post according to claim 1, wherein fastening devices are provided on the outer surface of the outer tube.

* * * * *